US005899011A

United States Patent [19]

Brinkman

[11] Patent Number: 5,899,011

[45] Date of Patent: May 4, 1999

[54] LABEL HOLDER FOR ATTACHMENT TO PRICE CHANNEL

[75] Inventor: Michael Brinkman, Coral Springs, Fla.

[73] Assignee: FEMC Ltd., Ft. Lauderdale, Fla.

[21] Appl. No.: 08/841,680

[22] Filed: Apr. 30, 1997

[51] Int. Cl.[6] ..... G09F 3/18

[52] U.S. Cl. ..... 40/661.03; 40/642.02; 40/649; 40/651; 248/231.81

[58] Field of Search ..... 40/642.02, 649, 40/651, 658, 661.03, 666; 248/223.41, 224.51, 231.81

[56] References Cited

U.S. PATENT DOCUMENTS

| | | | |
|---|---|---|---|
| 1,704,562 | 3/1929 | Egan | 40/658 X |
| 2,206,522 | 7/1940 | Varon | 40/658 |
| 2,827,718 | 3/1958 | Howard | 40/658 |
| 4,295,288 | 10/1981 | Westberg | 40/651 X |
| 4,426,797 | 1/1984 | Burkemper et al. | 40/651 |
| 4,866,868 | 9/1989 | Kass | 40/651 X |
| 5,044,104 | 9/1991 | Hopperdietzel | 40/649 X |
| 5,197,215 | 3/1993 | Torsleff | 40/649 X |
| 5,263,269 | 11/1993 | Tjarnlund . | |
| 5,419,066 | 5/1995 | Harnois et al. | 40/661.03 |
| 5,456,034 | 10/1995 | Lewis et al. . | |
| 5,473,833 | 12/1995 | Ostrovsky . | |
| 5,488,793 | 2/1996 | Gebka et al. . | |
| 5,509,634 | 4/1996 | Gebka et al. . | |
| 5,515,632 | 5/1996 | Gebka et al. | 40/649 |
| 5,572,822 | 11/1996 | Lynch et al. | 40/642.02 |
| 5,577,337 | 11/1996 | Lin | 40/642.02 |
| 5,720,398 | 2/1998 | Kump et al. | 248/231.81 X |

FOREIGN PATENT DOCUMENTS

| | | | |
|---|---|---|---|
| 0429400B1 | 11/1990 | European Pat. Off. . | |
| 0429400A1 | 5/1991 | European Pat. Off. . | |
| 3804894 | 8/1989 | Germany | 40/661 |

OTHER PUBLICATIONS

EZ–View Label Placement & Merchandising Systems, Catalog—vol. 1.

EZ–View Retail Label Holders and Sign Holders, Catalog, vol. 2.

EZ–View Nonadhesive Label Applications Instruction Manual.

*Primary Examiner*—Brian K. Green
*Assistant Examiner*—Andrea Chop
*Attorney, Agent, or Firm*—Jacobson, Price, Holman & Stern, PLLC

[57] ABSTRACT

A label holder for displaying information-containing non-adhesive labels on a C-channel at the front of a merchandise shelf in a supermarket or the like. The label holder may be a co-extrusion of an opaque body panel and a transparent cover resiliently connected along their lower edges to define a label-receiving pocket therebetween or it may simply have opposing U-shaped channels defined by upper and lower lips to receive and retain the label. A pair of upwardly and rearwardly extending leg members are integral with the body panel. One of the leg members underlies and extends behind the lower flange member of the C-channel and the other leg member overlies and extends in front of the lower flange member. The leg members terminate in gripping elements biased toward each other to grippingly engage therebetween the front and rear surfaces of the central portion of the C-channel. An upper lip may be provided on the body panel to engage behind the upper flange member of the C-channel and/or a rearwardly and downwardly depending flexible locking finger may be provided on the overlying leg member to engage behind the lower flange member of the C-channel.

18 Claims, 3 Drawing Sheets

LABEL HOLDER FOR ATTACHMENT TO PRICE CHANNEL

This invention relates to label holders for displaying information-containing labels on a channel member at the front of a merchandise shelf and relates more particularly to a plastic label holder adapted to be removably engaged with a shelf C-channel in a novel manner.

BACKGROUND OF THE INVENTION

Steel merchandise shelves commonly found in supermarkets and the like generally provide a generally C-shaped price channel along the front edge. Where such shelves are formed without a channel, plastic fittings can be added to the shelves to provide such channels. Price channels have upper and lower flange members along their edges and can be used to accommodate snap-in labels or label or sign holders adapted to receive and display non-adhesive paper or plastic labels or signs containing magnetic inventory bar coding or printed pricing or other such information for the consumer. Alternatively, adhesive-backed labels can be affixed directly to the front surface of the C-channel. While adhesive-backed labels may be secured to surfaces of varying dimensions, they are difficult to remove or replace when different merchandise is to be displayed on the shelf, and generally leave behind an unsightly adhesive residue. The cost of such labels is not only higher because of the adhesive, the labor costs associated with removing and replacing such labels significantly increases the overall expense of such systems.

Non-adhesive labels are less expensive to manufacture; additionally, they can generally be installed and removed much more readily. Moreover, the appearance of shelving provided with label holders adapted to removably receive non-adhesive labels is dramatically improved.

Depending upon the type of shelving, the price channel configuration may be different. Although the size of most price channels are fairly standard, no two shelves are exactly alike. Thus, the height of the channel formed between the upper and lower flange members may vary because of manufacturing tolerances, even on different shelves of the same shelf system.

Various attachments are currently on the market for adapting a C-channel to removably receive and display non-adhesive information-containing labels to a consumer. In most versions, one or more rearwardly extending flexible legs are provided with portions designed to snap into the upper and lower flanges of the C-channel. While such attachments may provide only upper and lower channels to receive and retain a paper or plastic label, much like the C-channel on the shelf, they commonly include a main body or backing panel and a hingedly attached transparent cover which together define a pocket between them for reception of the non-adhesive label. In some circumstances, a transparent label cover can be snapped directly onto a C-channel over the lower edge, providing a pocket for a non-adhesive label between the cover and the C-channel itself.

While each of the foregoing systems are useful, they each have limited application and one or more disadvantages. For example, while the label holders with rearwardly extending legs can accommodate C-channels of somewhat varying dimensions, they still must fit between and engage both the upper and lower flange elements limiting their versatility.

The snap-on covers rely heavily on their ability to mount on and pivot about the lower edge of a price channel placing great stress on the connection, particularly if the design of the shelf is somewhat unusual or if the lower edge of the channel is bent. Moreover, since the covers must be transparent in order for the information on the label to be viewed therethrough, any unsightly portion of the C-channel not hidden by a label is visible to passersby.

SUMMARY OF THE INVENTION

It is the primary object of the instant invention to provide a label holder for displaying information-containing non-adhesive labels on a channel member at the front of a merchandise shelf which overcomes the foregoing and other disadvantages attendant to prior art devices currently available.

Another object of this invention is the provision of a label holder which can accommodate greater variation in the configuration and dimensions of a C-channel to which it is attached.

Yet a further object of this invention is the provision of a plastic label holder which includes a pair of rearwardly extending leg members defining between them an enlarged pocket engaged loosely about the lower edge and flange of a C-channel, with free end portions of the leg members biased toward each other and adapted to grippingly engage the front and rear surfaces, respectively, of the central portion of the C-channel. Since the label holder is resiliently secured to the middle of the price channel, it need not directly contact the lower flange and can, therefore, be freely moved upwardly or downwardly to accommodate the height of the C-channel with which it is associated.

Another object of this invention is the provision of a label holder of the type described which may include upper and/or lower locking elements adapted to engage behind the upper and lower flanges on the C-channel, respectively, to further secure the label holder to the C-channel in use.

A further object of this invention is the provision of a label holder which loosely covers the lower flange and grippingly engages the middle of a C-channel and which is provided with an upwardly and rearwardly extending lip member carried by its upper edge portions for engagement behind the upper flange member of the C-channel thereby filling any space between the label holder and the upper and lower flanges of the channel member, precluding dirt from getting between these elements and, at the same time, acting to further secure the label holder to the top flange of the C-channel.

Another object of this invention is the provision of a label holder having the foregoing advantages which includes an opaque plastic body panel and which may be a co-extrusion of an opaque body panel with a transparent plastic cover member hingedly secured to the bottom thereof to define therebetween a pocket for reception of non-adhesive labels or the like, in either event, the opaque body panel spanning and visually blocking the C-channel to hide from view any old adhesive price tags or unsightly residue on the channel member.

Still other objects and advantages of the instant inventive concepts will be apparent to those skilled in the art from the ensuing description of the preferred embodiments and claims read in conjunction with the attached drawings.

BRIEF DESCRIPTION OF THE DRAWINGS

Like characters refer to like parts throughout the several views of the drawings.

DESCRIPTION OF THE PREFERRED EMBODIMENTS

Figure 2:
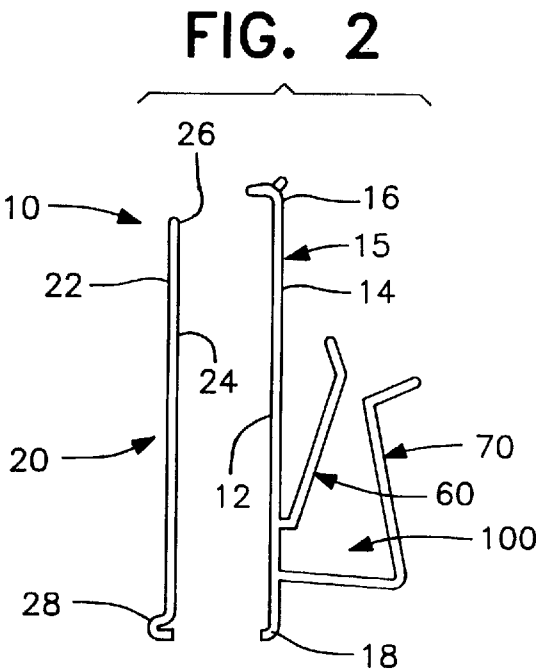
FIG. 2 is a reduced size exploded view of the label holder of FIG. 1 illustrating the co-extruded portions thereof in spaced-apart relationship.

Referring now to the drawings in general, and particularly to FIGS. 1–4, one form of label holder according to the instant inventive concepts is designated generally by the reference numeral 10, and comprises basically a generally planar opaque body panel 15, and a generally planar transparent cover 20. The body panel 15 has a front surface 12, a rear surface 14, an upper edge 16 and a lower edge 18. The cover 20 has a front surface 22, a rear surface 24, an upper edge 26 and a lower edge 28.

As seen in FIG. 2, the body panel 15 and the cover 20 are the result of a co-extrusion, the former being formed, preferably, of an opaque, perhaps colored, polyvinyl chloride, and the latter preferably being formed of a transparent polyvinyl chloride to enable a non-adhesive paper or plastic label or the like (not shown) to be received in the pocket 30 between the body panel 15 and the cover 20, and viewed through the transparent cover 20 for scanning bar codes or the like or for visually observing printed information contained thereon.

Figure 1:
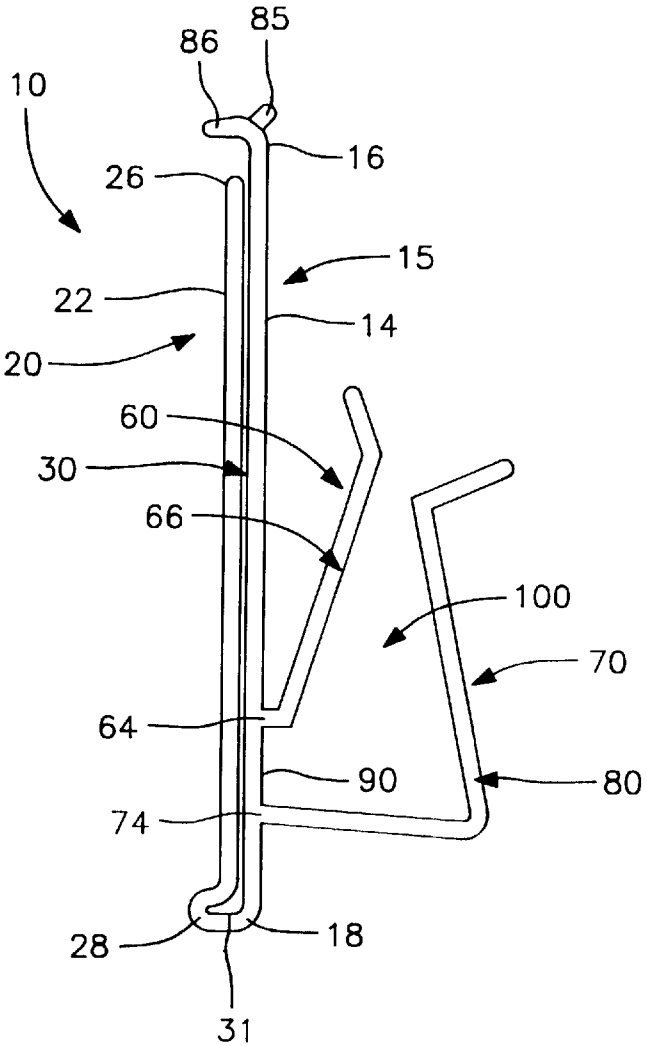
FIG. 1 is a side elevational view of one embodiment of a label holder according to the instant inventive concepts.

The co-extrusion process is well known, and the lower edges 18, 28 of the body panel 15 and the cover 20 are integrally joined at 31 to provide a flexible interconnection, biasing the cover 20 toward the position shown in FIG. 1, but permitting the cover to be bent outwardly from the body panel for insertion and removal of the non-adhesive labels into and from the pocket 30.

Figure 4:
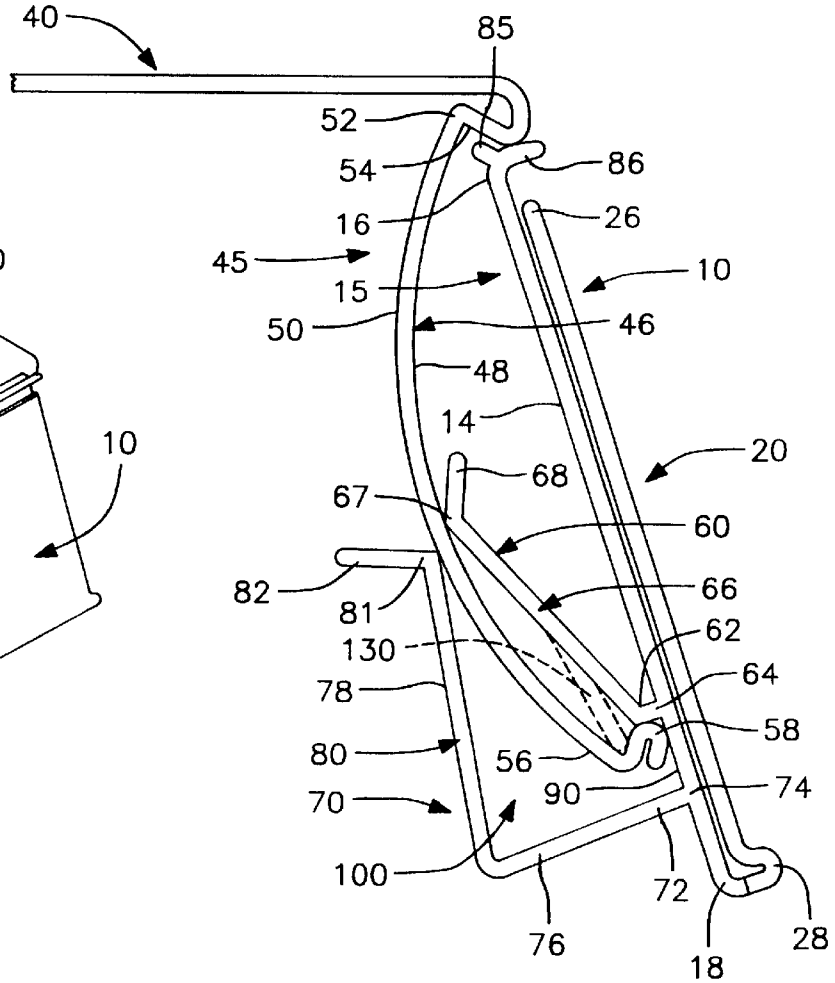
FIG. 4 is an enlarged side elevational view further illustrating the manner in which the label holder of FIG. 1 is attached to the C-channel.
Figure 3:
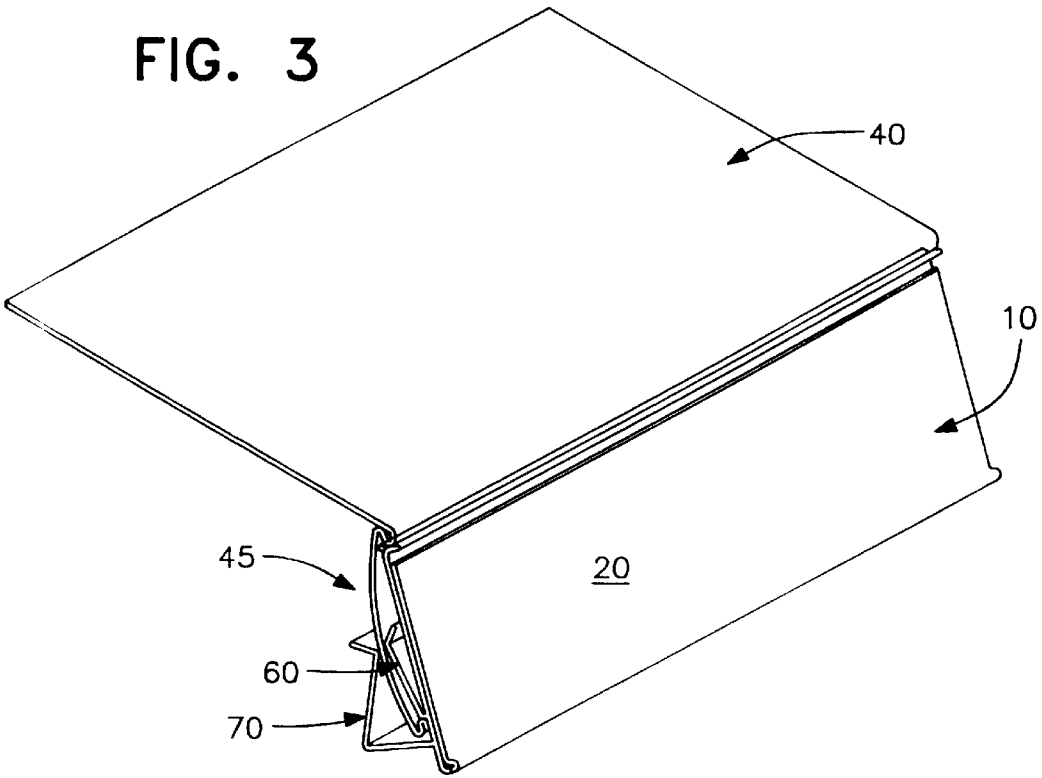
FIG. 3 is a perspective view of the label holder of FIG. 1 secured in place on a C-channel at the front of a merchandise shelf.

The label holder 10 is adapted to be removably secured to a merchandise shelf 40 or the like having a channel member, such as the C-channel or the like 45 shown in FIGS. 3 and 4, formed along its front edge. The C-channel 45 commonly includes an elongated central portion 46, generally arcuate in form, having a front surface 48 and a rear surface 50, and terminating in an upper edge 52 including a forwardly and downwardly extending upper flange 54, and a lower edge 56 including a forwardly and upwardly extending flange member 58.

The specific details of the C-channel or the merchandise shelf are not part of the instant inventive concepts, except to the extent that they generally include the elements identified above which are adapted to cooperate with a label holder according to this invention in the manner discussed hereinafter.

In order to enable the label holder 10 to be removably secured to the C-channel 45 without critical consideration of the configuration or dimensions of the C-channel, the body panel 15 is provided with a pair of rearwardly extending channel gripping members 60, 70. The lower end 62 of the first channel gripping member 60 is integral with or secured to the rear surface 14 of the body panel 15 at a point 64 intermediate its upper and lower edges 16, 18. From the point of engagement 64 with the rear surface 14 of the body panel 15, the first channel gripping member 60 comprises an upwardly and rearwardly extending leg member 66 with an offset foot element 68 at its distal end extending toward the rear surface 14 of the body panel 15, the apex 67 between the leg member 66 and the foot element 68 engaging the front surface 48 of the central portion 46 of the C-channel 45 in use as will be seen in FIGS. 3 and 4.

The lower end 72 of the second channel gripping member 70 is integral with or secured to the rear surface 14 of the body panel 15 at a point 74 spaced below the point 64 at which the first gripping member 60 is secured. From the point of engagement 74 with the rear surface 14 of the body panel 15, the second channel gripping member 70 comprises downwardly and upwardly extending portions 76, 78 of an upwardly and rearwardly extending leg member 80 with an offset foot element 82 extending away from the rear surface 14 of the body panel 15, at its distal end. The apex 81 between the leg member 80 and the foot element 82 of the second channel gripping member 70 is adapted to engage the rear surface 50 of the central portion 46 of the C-channel 45 in use.

The leg members 66, 80 of the first and second channel gripping members 60, 70, respectively, bias their respective free end portions toward each other for grippingly engaging therebetween the front and rear surfaces 48, 50, respectively, of the central portion 46 of the C-channel 45 for removably securing the label holder 10 to the channel member 45 of the shelf 40.

An upwardly and rearwardly extending lip member 85 is provided at the upper edge 16 of the body panel 15 to extend behind the upper flange member 54 of the channel member 45 in use and to, thereby, fill any space between the label holder back panel 15 and the upper and lower flanges 54, 58 of the channel member 45. Because of the opaque nature of the body panel 15, the area behind the label holder 10 is hidden from view, covering any unsightly residue of adhesive labels previously secured to the C-channel and precluding dirt from getting behind the label holder 10 when it is engaged with the C-channel 45. Additionally, the upper flange member 85 will further secure the back of the label holder to the upper flange 54 of the C-channel 45. A ledge member 86 may also be provided at the upper end 16 of the body panel 15 to abut the upper flange member 54 of the C-channel 45 and, thereby, stabilize the engagement of the label holder 10 with the channel member 45.

It will be seen that the body panel 15 of the label holder 10 is dimensioned to more than span the space between the upper and lower flanges 54, 58 of the C-channel 45. Preferably, the portion 90 of the rear surface 14 of the body panel 15 between the points 64, 74 at which the lower ends 62, 72 of the first and second channel gripping members 60, 70 are secured is dimensioned to freely receive the lower flange member 58 of the channel member 45. As seen in FIG. 4, the portion 90 of the rear surface 14 of the body panel 15 may rest against the forward portion of the lower flange 58 of the C-channel, and the lower end 62 of the first channel gripping member 60 may rest on the upper portion of the lower flange member 58 of the channel member 45 in use to assist in positioning the label holder 10 on the channel member 45.

The foregoing relationship is desirable, but not critical to the advantageous operation of the label holder of this invention. Of importance, however, is the fact that a relatively enlarged pocket 100 is formed between the first and second channel gripping members 60, 70 so that the label holder 10 need not fit exactly between the upper and lower flange members 54, 58 of the channel member 45. The lower edge of the label holder 10 need not engage the lower flange 58 of the C-channel 45 or pivot about the lower edge of the C-channel as in most prior art devices since the securement of the label holder 10 to the C-channel 45 actually takes place in the central portions 46 of the channel member, between the apexes 67, 81 of the first and second channel gripping members 60, 70, respectively. The ledge 86 at the top of the body panel 15 will actually position the top of the label holder 10 relative to the C-channel 45 and the large pocket 100 effectively permits the label holder 10 to slide upwardly, or downwardly about the lower flange member 58, as necessary.

The use and application of the label holder 10 will be readily understood by those skilled in the art. At a point where it is desired to display an information-containing non-adhesive label, a label holder 10 can simply be slidingly engaged over the bottom of the C-channel 45, with the upper lip 85 of the label holder 10 behind the upper flange member 54 of the C-channel 45, and the ledge 86 engaged beneath the upper flange member 54 to position the label holder 10 and stabilize the same. The first and second channel gripping members 60, 70 engage the front and rear surfaces 48, 50 of the central portion 46 of the C-channel 45 and slide upwardly or downwardly to accommodate slight variations in the height of the C-channel. In this manner, the label holder 10 is removably secured to the C-channel 45 at any desired position, may be slid sideways to reposition the same, or readily removed entirely for re-use elsewhere without the need for extraneous tools. Non-adhesive labels can be inserted into the pocket 30 and replaced at will. Visual and electronic viewing of the information carried on such labels through the transparent cover 20 is readily effected, while the front surface 48 of the C-channel 45 is visually hidden by the opaque body panel 15 and protected by the label holder 10.

Figure 5:
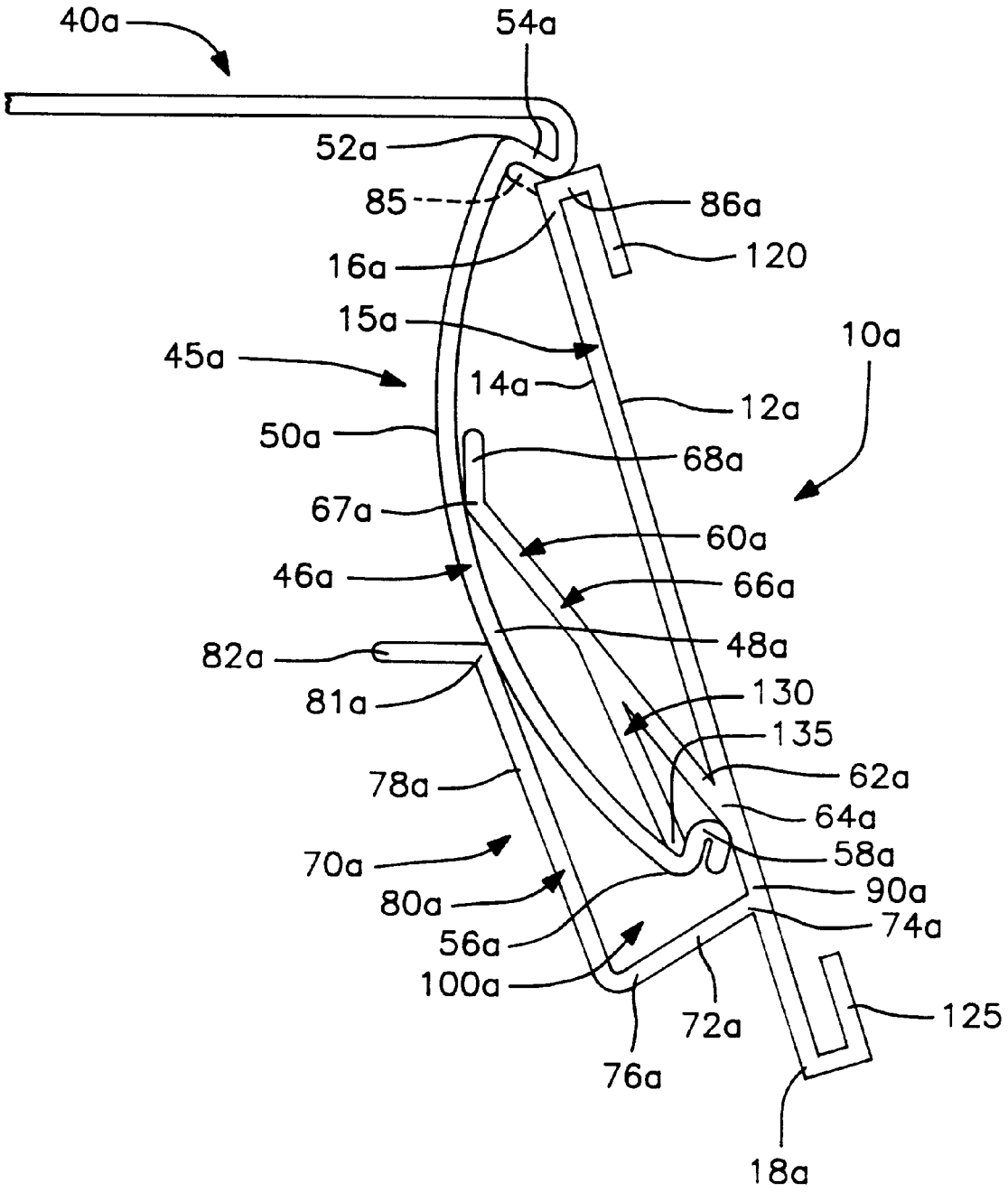
FIG. 5 is a view like FIG. 4, but illustrating a modified form of label holder according to the instant inventive concepts.

Referring now to the embodiment of FIG. 5, elements similar to those of the label holder 10 of FIGS. 1–4, have been designated by the same reference numeral followed by the suffix "a". Label holder 10*a* of FIG. 5 functions in a very similar manner to the label holder 10 of the earlier embodiment, although the construction is somewhat different in several respects. First, label holder 10*a* does not include a cover such as the element 20 in the earlier embodiment. Rather, at the top of the label holder 10*a,* a downwardly depending lip 120 is provided, and at the bottom of the label holder 10*a,* an upwardly extending lip 125 is provided. In this construction, the paper label or the like (not shown) may be snapped into the opposing channels formed at the top and bottom of the label holder 10*a* to be retained against the front face 12*a* of the body panel 15*a* by the lips 120, 125 in an obvious manner, quite like the C-channel itself is adapted to receive and retain a non-adhesive label between its upper and lower flanges 54*a,* 58*a.*

The label holder 10*a* in FIG. 5 is not shown as including an upper locking member such as seen at 85 in the embodiment of FIGS. 1–4. The label holder 10*a,* however, includes a lower locking member in the form of an integral locking finger 130 depending downwardly from an intermediate portion of the rear surface of the leg member 66*a* of the first channel gripping member 60*a*. The free end portion 135 of the locking finger 130 is adapted to engage behind the lower flange member 58*a* of the C-channel 45*a* in use. In fact, as the label holder 10*a* is engaged with the C-channel 45*a,* the locking finger 130 rides up over the lower flange member 58*a* and springs into place to avoid accidental disengagement of the label holder 10*a* with the C-channel 45*a.*

Although the embodiments 10, 10*a* of a label holder according to the instant inventive concepts each include slightly different features, it is to be understood that the features of the label holder 10 shown in FIGS. 1–4 can be incorporated into the label holder 10*a* of FIG. 5 to the extent that they are not inconsistent therewith and, likewise, the features of the label holder 10*a* can be incorporated into the label holder 10, if desired.

For example, label holder 10 can be formed without the transparent cover 20 and modified to include upper and lower lip elements similar to those shown at 120, 125 in FIG. 5.

Similarly, the label holder 10 can be provided with a locking finger such as seen at 130 in FIG. 5, and the label holder 10*a* of FIG. 5 can be provided with a rearwardly and upwardly extending lip member at its upper end such as shown at 85 in the label holder 10. Effectively, upper locking means such as the lip 85, lower locking means such as the locking finger 130, or both, may be incorporated in a single label holder according to this invention. These alternative embodiments have been shown in dotted lines in FIGS. 4 and 5, respectively.

While only preferred embodiments of the invention have been described herein in detail, the invention is not limited thereby and modifications can be made within the scope of the attached claims.

I claim:

1. A label holder for displaying information-containing labels on a channel member at the front of a merchandise shelf, wherein the channel member includes an elongated central portion having front and rear surfaces and upper and lower edges defining forwardly extending upper and lower flange members, respectively, said label holder comprising a generally planar body panel having front and rear surfaces and upper and lower edges, means for receiving and removably retaining a label in contact with said front surface of said body panel, a first channel gripping member having a lower end secured to said rear surface of said body panel intermediate its upper and lower edges, and including an upwardly and rearwardly extending leg member terminating in a free channel front surface engaging end portion, a second channel gripping member having a lower end secured to said rear surface of said body panel at a position spaced below the point at which said lower end of said first channel gripping member is secured to said rear surface of said body panel, said second channel gripping member including an upwardly and rearwardly extending leg member terminating in a free channel rear surface engaging end portion, said leg members of said first and second channel gripping members biasing their respective free end portions toward each other for grippingly engaging the front and rear surfaces, respectively, of the central portion of the channel member therebetween for removably securing said label holder to the channel member, said leg member of said first channel gripping member including an offset foot element at its said free channel front surface engaging end portion, said first channel gripping member foot element extending toward said rear surface of said body panel, and the apex between said first channel gripping member leg member and said foot element of said first channel gripping member engaging the front surface of the central portion of the channel member in use; and said leg member of said second channel gripping member including an offset foot element at said free channel rear surface engaging end portion, said second channel gripping member foot element extending away from said rear surface of said body panel, and the apex between said second channel gripping member leg member and said foot element of said second channel gripping member engaging the rear surface of the central portion of the channel member in use.

2. A label holder according to claim 1, wherein said means for receiving and removably retaining a label comprises a generally planar transparent cover having front and rear surfaces and upper and lower edges, said lower edges of said body panel and said cover being flexibly connected to each other to define a pocket between said front surface of said body panel and said rear surface of said cover for removable reception of the label.

3. A label holder according to claim 1, wherein said means for receiving and removably retaining a label comprises upper and lower U-shaped channels facing each other and defined by a forwardly and downwardly depending lip formed on said upper edge of said body panel and a forwardly and upwardly extending lip formed on said lower edge of said body panel.

4. A label holder according to claim 1 further including a rearwardly and upwardly extending lip member formed on said upper edge of said body panel and having a terminal end portion adapted to engage behind the upper flange member of the channel member.

5. A label holder according to claim 1 further including a rearwardly and downwardly extending locking finger provided on said leg member of said first channel gripping member and having a terminal end portion adapted to engage behind the lower flange member of the channel member.

6. A label holder according to claim 1, further including a rearwardly and upwardly extending lip member formed on said upper edge of said body panel and having a terminal end portion adapted to engage behind the upper flange member of the channel member, and a rearwardly and downwardly extending locking finger provided on said leg member of said first channel gripping member and having a terminal end portion adapted to engage behind the lower flange member of the channel member.

7. A label holder according to claim 1 wherein said label holder is a co-extrusion of an opaque plastic material forming said body panel and a transparent plastic material forming said cover.

8. A label holder according to claim 1, wherein the portion of said rear surface of said body panel between the points at which said lower ends of said first and second channel gripping members are secured is dimensioned to receive the lower flange member of the channel member, whereby said portion of said rear surface of said body panel rests against the lower flange member of the channel member in use.

9. A label holder according to claim 8 wherein said lower end of said first channel gripping member rests on the lower flange member of the channel member in use.

10. A label holder according to claim 1, further including a ledge member defined at said upper edge of said body panel, the upper flange member of the channel member abutting the ledge member in use.

11. In combination, a merchandise shelf having a channel member defined at its front edge, said channel member comprising an elongated central portion having front and rear surfaces, and upper and lower edge portions, said upper edge portion defining a forwardly and downwardly extending upper flange member, and said lower edge portion defining a forwardly and upwardly extending lower flange member, and at least one label holder according to claim 1 mounted on said channel member with said channel front and rear surface engaging portions of said first and second channel gripping members, respectively, grippingly engaging therebetween said front and rear surfaces of said central portion of said channel member, said leg member of said first channel gripping member overlying said lower flange member, and said leg member of said second channel gripping member underlying said lower flange member.

12. The combination of claim 11, wherein said means for receiving and removably retaining a label comprises a generally planar transparent cover having front and rear surfaces and upper and lower edges, said lower edges of said body panel and said cover being flexibly connected to each other to define a pocket between said front surface of said body panel and said rear surface of said cover for removable reception of the label.

13. The combination of claim 11, wherein said means for receiving and removably retaining a label comprises upper and lower U-shaped channels facing each other and defined by a forwardly and downwardly depending lip formed on said upper edge of said body panel and a forwardly and upwardly extending lip formed on said lower edge of said body panel.

14. The combination of claim 11, wherein said body panel is opaque to thereby visually block said central portion of said channel member.

15. In combination, a merchandise shelf having a channel member defined at its front edge, said channel member comprising an elongated central portion having front and rear surfaces, and upper and lower edge portions, said upper edge portion defining a forwardly and downwardly extending upper flange member, and said lower edge portion defining a forwardly and upwardly extending lower flange member, and at least one label holder mounted on said channel member, said label holder comprising a generally planar body panel having front and rear surfaces and upper and lower edges, means for receiving and removably retaining a label in contact with said front surface of said body panel, a first channel gripping member having a lower end secured to said rear surface of said body panel intermediate its upper and lower edges, and including an upwardly and rearwardly extending leg member terminating in a free channel front surface engaging end portion, a second channel gripping member having a lower end secured to said rear surface of said body panel at a position spaced below the point at which said lower end of said first channel gripping member is secured to said rear surface of said body panel, said second channel gripping member including an upwardly and rearwardly extending leg member terminating in a free channel rear surface engaging end portion, said channel front and rear surface engaging portions of said first and second channel gripping members, respectively, grippingly engaging therebetween said front and rear surfaces of said central portion of said channel member, said leg member of said first channel gripping member overlying said lower flange member, and said leg member of said second channel gripping member underlying said lower flange member, further including a stabilizing element defined at said upper edge of said body panel, said stabilizing element engaging said upper flange member of said channel member.

16. In combination, a merchandise shelf having a channel member defined at its front edge, said channel member comprising an elongated central portion having front and rear surfaces, and upper and lower edge portions, said upper edge portion defining a forwardly and downwardly extending upper flange member, and said lower edge portion defining a forwardly and upwardly extending lower flange member, and at least one label holder mounted on said channel member, said label holder comprising a generally planar body panel having front and rear surfaces and upper and lower edges, means for receiving and removably retaining a label in contact with said front surface of said body panel, a first channel gripping member having a lower end secured to said rear surface of said body panel intermediate its upper and lower edges, and including an upwardly and rearwardly extending leg member terminating in a free channel front surface engaging end portion, a second channel gripping member having a lower end secured to said rear surface of said body panel at a position spaced below the point at which said lower end of said first channel gripping member is secured to said rear surface of said body panel, said second channel gripping member including an upwardly and rearwardly extending leg member terminating in a free channel rear surface engaging end portion, said channel front and rear surface engaging portions of said first and second channel gripping members, respectively, grippingly engaging therebetween said front and rear surfaces of said central portion of said channel member said leg member of said first channel gripping member overlying said lower flange member, and said leg member of said second channel gripping member underlying said lower flange member, further including a lip member extending rearwardly and upwardly from said upper edge of said body panel, said lip member being engaged behind said upper flange member of said channel member.

17. In combination, a merchandise shelf having a channel member defined at its front edge, said channel member comprising an elongated central portion having front and rear surfaces, and upper and lower edge portions, said upper edge portion defining a forwardly and downwardly extending upper flange member, and said lower edge portion defining a forwardly and upwardly extending lower flange member, and at least one label holder mounted on said channel member, said label holder comprising a generally planar body panel having front and rear surfaces and upper and lower edges, means for receiving and removably retaining a label in contact with said front surface of said body panel, a first channel gripping member having a lower end secured to said rear surface of said body panel intermediate its upper and lower edges, and including an upwardly and rearwardly extending leg member terminating in a free channel front surface engaging end portion, a second channel gripping member having a lower end secured to said rear surface of said body panel at a position spaced below the point at which said lower end of said first channel gripping member is secured to said rear surface of said body panel, said second channel gripping member including an upwardly and rearwardly extending leg member terminating in a free channel rear surface engaging end portion, said channel front and rear surface engaging portions of said first and second channel gripping members, respectively, grippingly engaging therebetween said front and rear surfaces of said central portion of said channel member, said leg member of said first channel gripping member overlying said lower flange member, and said leg member of said second channel gripping member underlying said lower flange member, further including a rearwardly and downwardly extending locking finger provided on said leg member of said first channel gripping member and having a terminal end portion engaged behind said lower flange member of said channel member.

18. In combination, a merchandise shelf having a channel member defined at its front edge, said channel member comprising an elongated central portion having front and rear surfaces, and upper and lower edge portions, said upper edge portion defining a forwardly and downwardly extending upper flange member, and said lower edge portion defining a forwardly and upwardly extending lower flange member, and at least one label holder mounted on said channel member, said label holder comprising a generally planar body panel having front and rear surfaces and upper and lower edges, means for receiving and removably retaining a label in contact with said front surface of said body panel, a first channel gripping member having a lower end secured to said rear surface of said body panel intermediate its upper and lower edges, and including an upwardly and rearwardly extending leg member terminating in a free channel front surface engaging end portion, a second channel gripping member having a lower end secured to said rear surface of said body panel at a position spaced below the point at which said lower end of said first channel gripping member is secured to said rear surface of said body panel, said second channel gripping member including an upwardly and rearwardly extending leg member terminating in a free channel rear surface engaging end portion, said channel front and rear surface engaging portions of said first and second channel gripping members, respectively, grippingly engaging therebetween said front and rear surfaces of said central portion of said channel member, said leg member of said first channel gripping member overlying said lower flange member, and said leg member of said second channel gripping member underlying said lower flange member, further including a rearwardly and upwardly extending lip member formed on said upper edge of said body panel and having a terminal end portion engaged behind said upper flange member of said channel member, further including a rearwardly and downwardly extending locking finger provided on said leg member of said first channel gripping member and having a terminal end portion engaged behind said lower flange member of said channel member.

* * * * *